US007223032B2

(12) United States Patent
Liu et al.

(10) Patent No.: US 7,223,032 B2
(45) Date of Patent: May 29, 2007

(54) FIXING ELEMENT CAPABLE OF ROTATABLY FIXING A RIBBON ROLLER IN A RIBBON CARTRIDGE

(75) Inventors: Jung-Chi Liu, Chang-Hua Hsien (TW); Yu-Feng Lin, Taipei Hsien (TW)

(73) Assignee: Hi-Touch Imaging Technologies Co., Ltd., Pan-Chiao, Taipei Hsien (TW)

( * ) Notice: Subject to any disclaimer, the term of this patent is extended or adjusted under 35 U.S.C. 154(b) by 0 days.

(21) Appl. No.: 11/163,576

(22) Filed: Oct. 24, 2005

(65) Prior Publication Data

US 2007/0041769 A1 Feb. 22, 2007

(30) Foreign Application Priority Data

Aug. 19, 2005 (TW) ..... 94128422 A

(51) Int. Cl.
*B65H 75/00* (2006.01)

(52) U.S. Cl. ..... 400/242; 400/208; 400/247; 242/579; 242/590; 242/608; 242/613

(58) Field of Classification Search ..... None
See application file for complete search history.

(56) References Cited

U.S. PATENT DOCUMENTS

| | | | | |
|---|---|---|---|---|
| 4,984,915 | A * | 1/1991 | Tashiro et al. | 242/597.3 |
| 5,439,303 | A * | 8/1995 | Alday | 400/242 |
| 5,492,422 | A * | 2/1996 | Kondo | 400/208.1 |
| 5,915,860 | A * | 6/1999 | Laurent | 400/242 |
| 6,425,548 | B2 * | 7/2002 | Christensen et al. | 242/571.4 |
| 6,726,144 | B2 * | 4/2004 | Squires | 242/597.6 |
| 6,905,268 | B1 * | 6/2005 | Holland et al. | 400/242 |

* cited by examiner

*Primary Examiner*—Judy Nguyen
*Assistant Examiner*—Jill E. Culler
(74) *Attorney, Agent, or Firm*—Winston Hsu

(57) ABSTRACT

A ribbon roller is fixed in a ribbon cartridge via a fixing element. The fixing element includes an accommodation means and a fastening element. The accommodation means fixes a tab of the ribbon roller, and the fastening element engages the ribbon cartridge. When transporting the ribbon cartridge, the fixing element is capable of preventing the ribbon roller from rotating so as to prevent the ribbon from wrinkling and affecting printing quality.

7 Claims, 6 Drawing Sheets

FIXING ELEMENT CAPABLE OF ROTATABLY FIXING A RIBBON ROLLER IN A RIBBON CARTRIDGE

BACKGROUND OF THE INVENTION

1. Field of the Invention

The present invention relates to a fixing element, and more particularly, to a fixing element for rotatably fixing a ribbon roller in a ribbon cartridge.

2. Description of the Prior Art

Ribbons of thermal printers are typically rolled on two ribbon rollers, which are respectively positioned on each side of a ribbon cartridge. However, there is no fixing mechanism available for firmly fixing the ribbon rollers within the ribbon cartridge. This results in undesirable rotation of the ribbon roller due to external vibration or shock when transporting the ribbon cartridge, which can cause the ribbon to become wrinkled. Printing quality can be detrimentally affected if the ribbon is wrinkled.

Generally, the prior art prevents the ribbon roller from rotating via a friction force. Please refer to FIG. 1, which is a diagram of preventing a ribbon roller 12 from rotating according to the prior art. There is a block 14 positioned at an end of a ribbon-feeding bay in a ribbon cartridge 10. The length of the ribbon roller 12 is longer than a distance between the block 14 and a base 16, so that the ribbon roller 12 presses the block 14. The pressed block 14 can provide a restoring force to the ribbon roller 12 towards the base 16, resulting in generation of a friction force between the ribbon roller 12 and the base 16 that prevents the ribbon roller 12 from rotating. Additionally, the block 14 can be replaced by other flexible elements, which can provide a force to push the ribbon roller 12 towards the base 16.

However, the block 14 is formed along with the ribbon cartridge 10. When manufacturing the ribbon cartridge 10, the distance between the block 14 and the base 16 has some tolerance, causing the restoring force to be inconsistent and thus the friction force to vary. If the friction force is too small, the ribbon might end up dangling out of the ribbon cartridge 10. On the contrary, if the friction force is too large, a printer cannot make the ribbon rotate. Additionally, if the block 14 is replaced by a spring or a flexible element, the restoring force may vary due to elastic fatigue.

Please refer to FIG. 2, which shows an etched surface 17 engaging a protrusion 18 to prevent the ribbon roller 12 from rotating based on the prior art. In order to control the friction force, the etched surface 17 is placed at the end of the ribbon roller 12 contacting the base 16, and the protrusion 18 is placed at the base 16 to engage the etched surface 17 so as to prevent the ribbon roller 12 from rotating. However, this method cannot absolutely solve the problem. If the restoration force provided by the block 14 is not large enough to make the etched surface 17 engage the protrusion 18, the ribbon roller 12 might rotate.

SUMMARY OF THE INVENTION

It is therefore a primary objective of the claimed invention to provide a fixing element for rotatably fixing a ribbon roller in a ribbon cartridge to solve the above-mentioned problem.

The claimed invention discloses a fixing element comprising an accommodation means and a fastening element. The accommodation means can fix a first tab of the ribbon roller, and the fastening element can engage the ribbon cartridge.

These and other objectives of the present invention will no doubt become obvious to those of ordinary skill in the art after reading the following detailed description of the preferred embodiment that is illustrated in the various figures and drawings.

DETAILED DESCRIPTION

In order to solve the problem of the prior art, the present invention provides a fixing element for fixing a ribbon roller in a ribbon cartridge.

Figure 1:
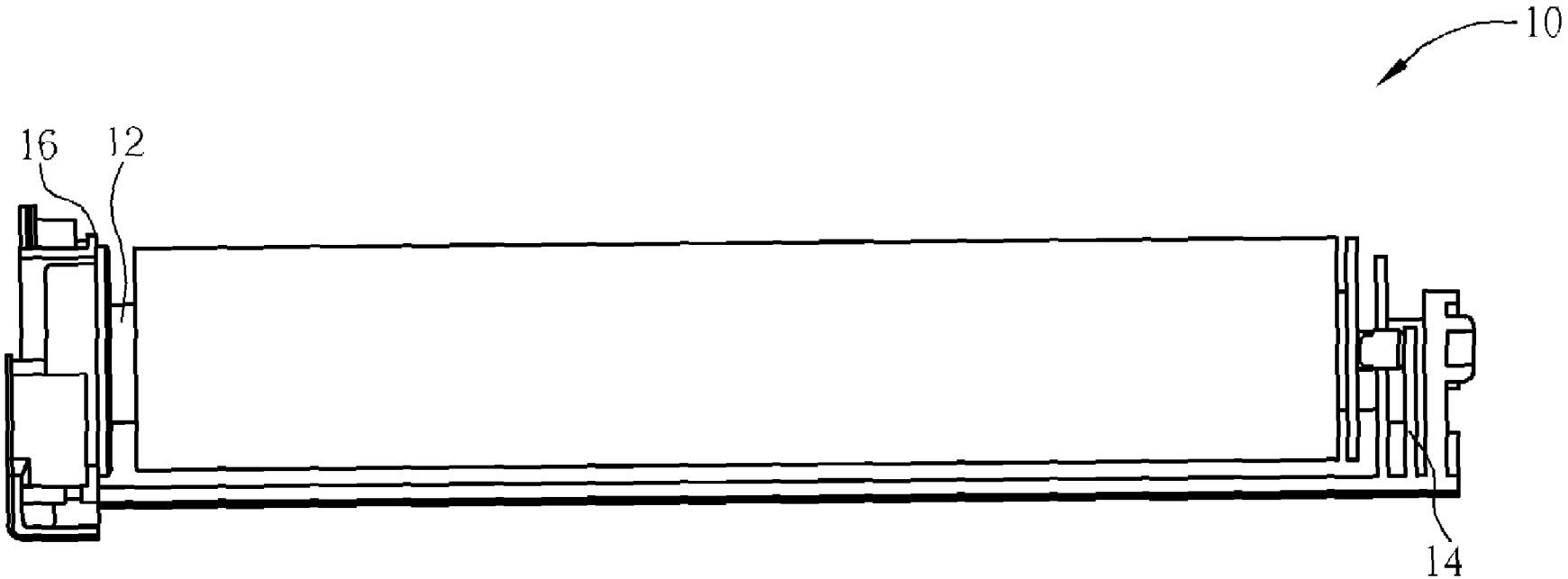
Fig. 1 Prior art
FIG. 1 is a diagram of preventing a ribbon roller from rotating according to the prior art.
Figure 2:
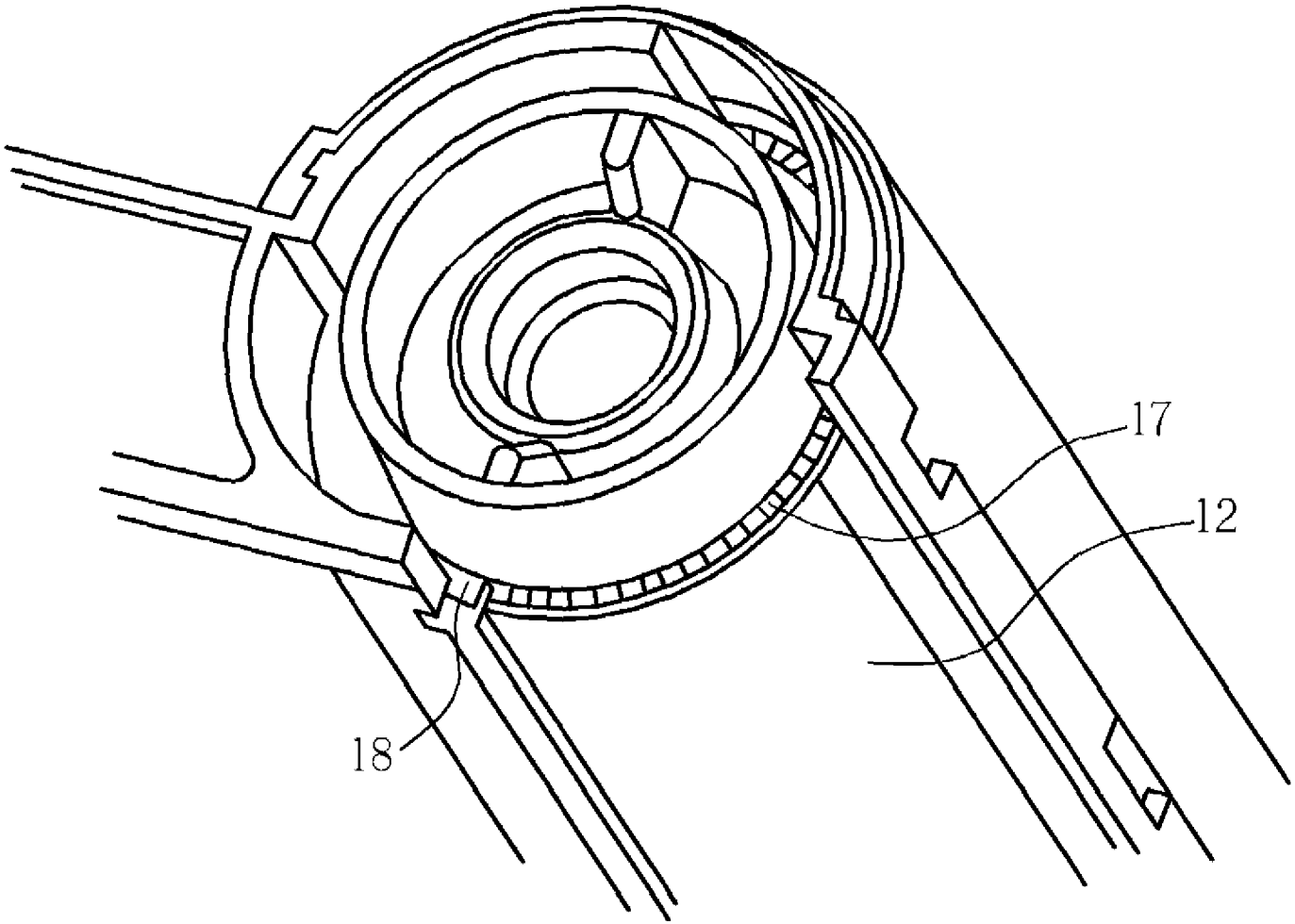
Fig. 2 Prior art
FIG. 2 shows an etched surface engaging a protrusion to prevent a ribbon roller from rotating based on the prior art.
Figure 3:
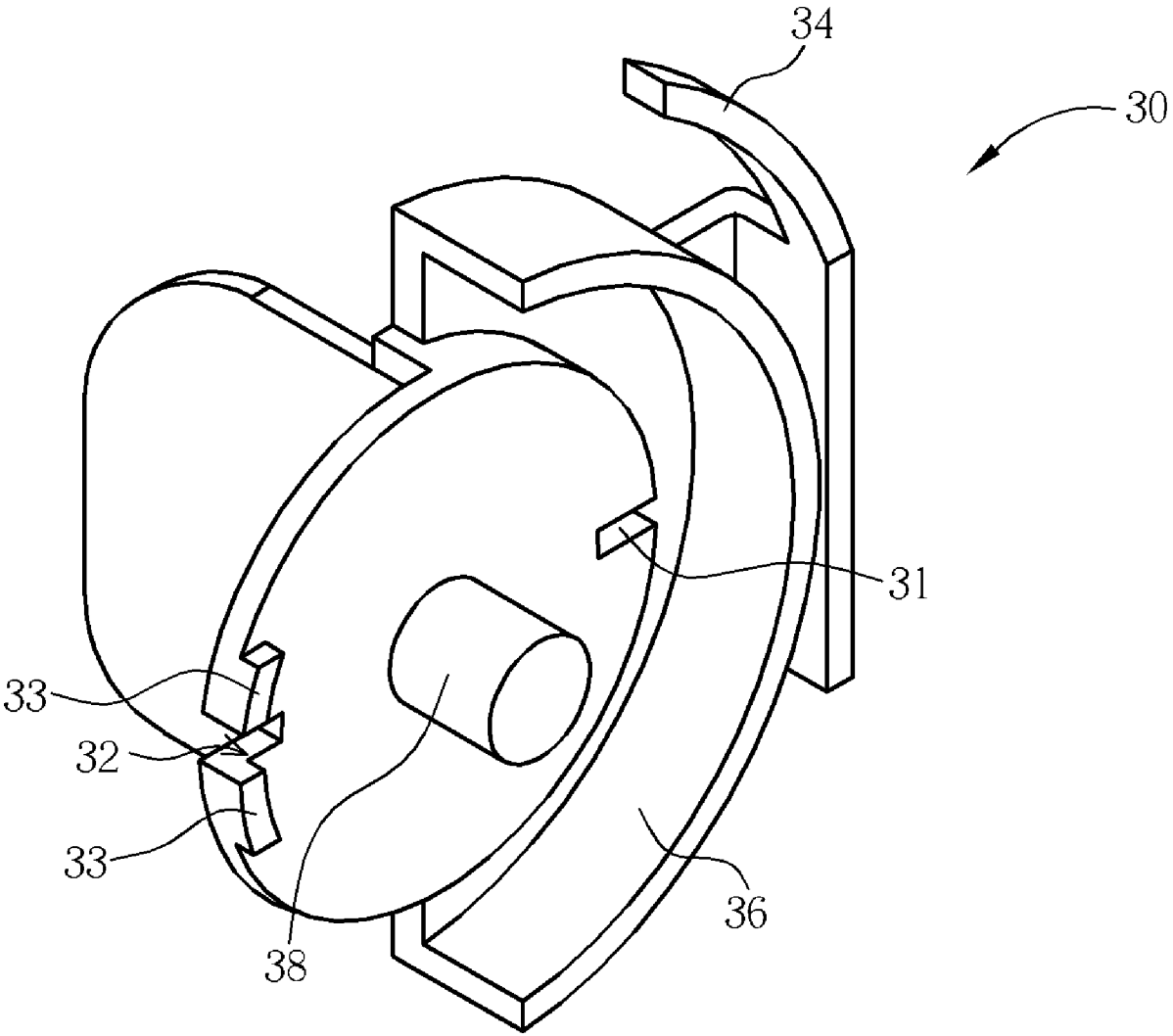
FIG. 3 is a diagram of a fixing element according to the present invention.
Figure 4:
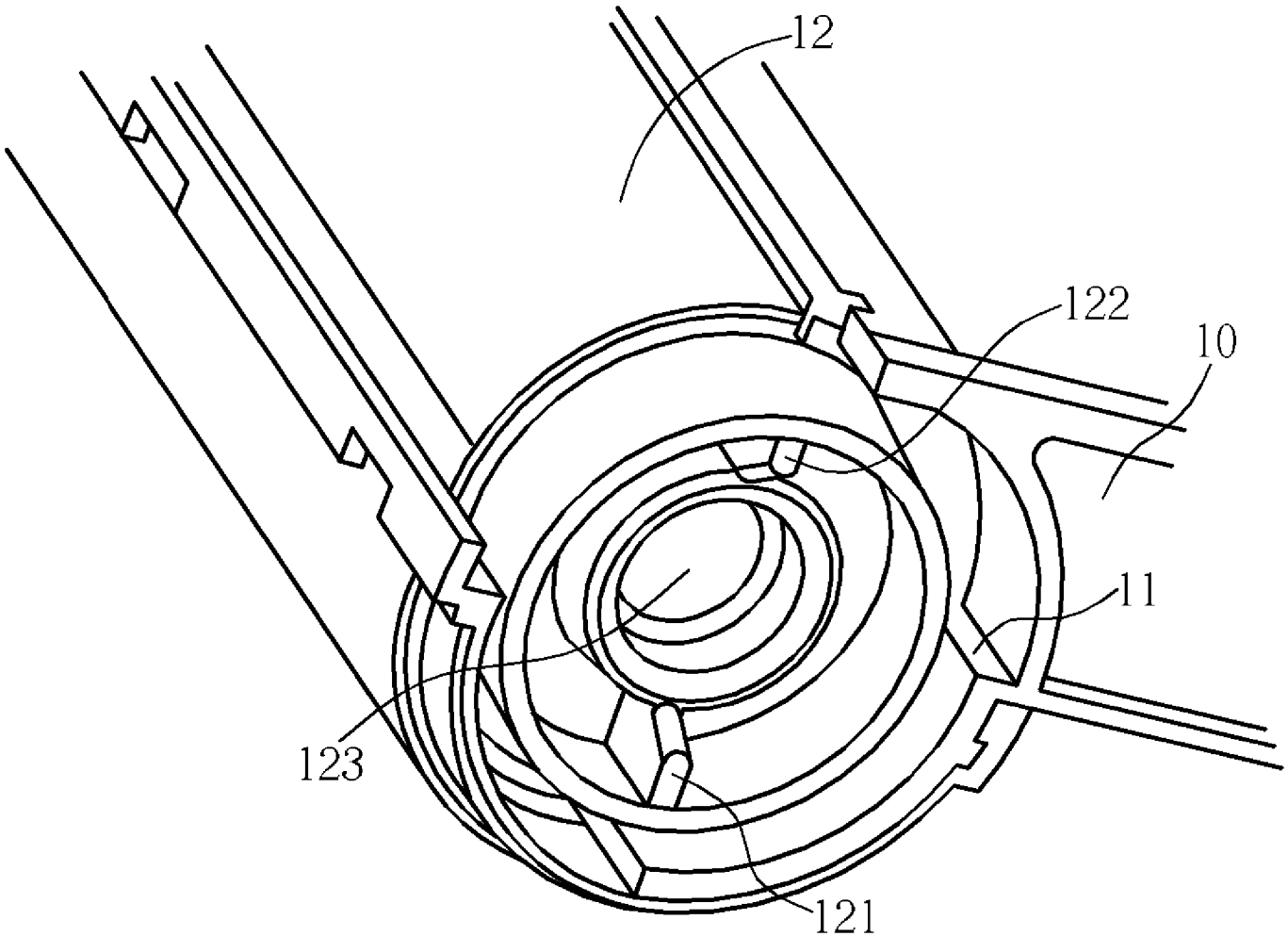
FIG. 4 shows a ribbon roller positioned in a ribbon cartridge according to the present invention.
Figure 5:
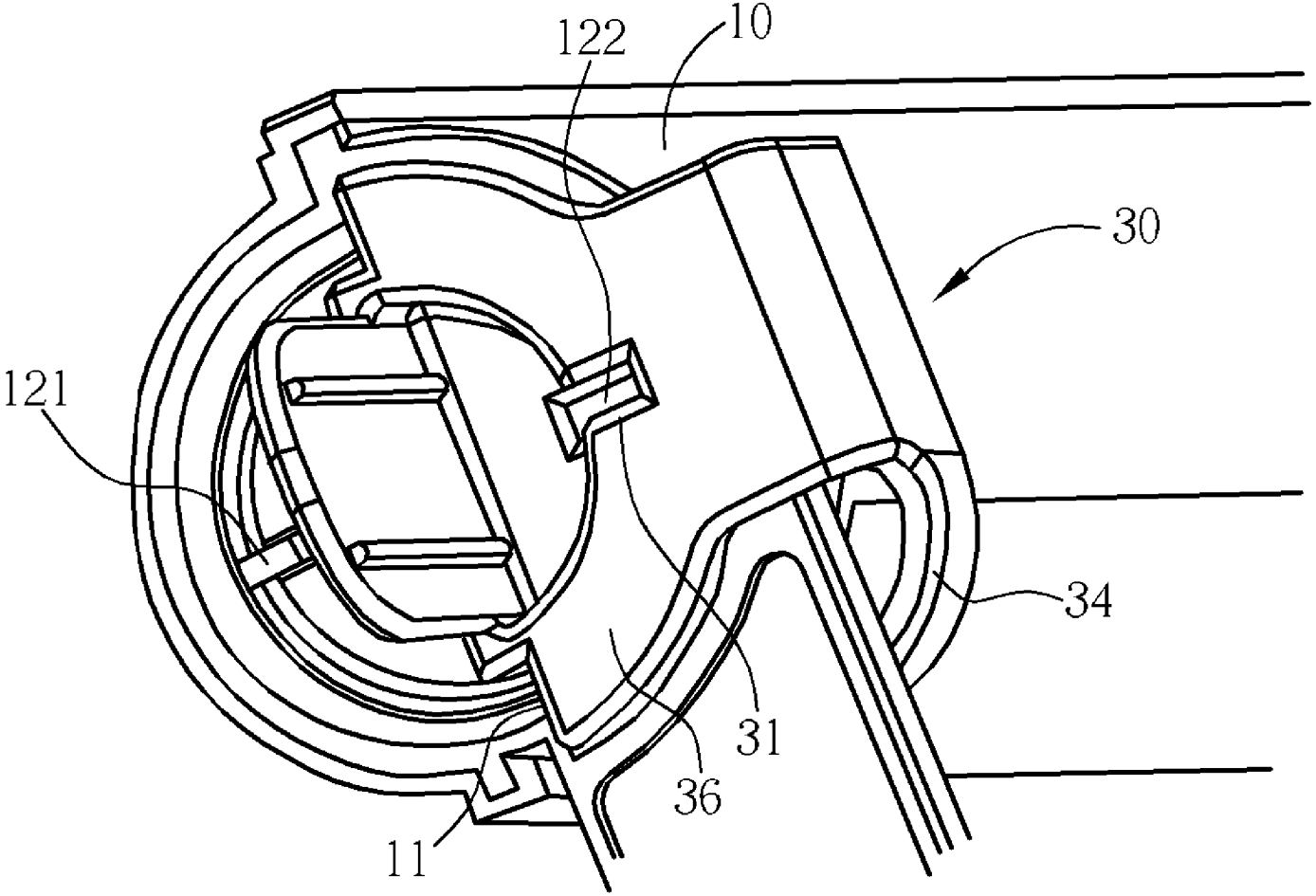
FIG. 5 shows an assembly of the fixing element of FIG. 3 and the part of FIG. 4.

Please refer to FIG. 3, which is a diagram of a fixing element 30 according to the present invention. The fixing element 30 comprises an accommodation means 32, a fastening element 34, an opening 31, a support 36, and a pin 38. Please also refer to FIG. 4, which shows the ribbon roller 12 positioned in the ribbon cartridge 10. From FIGS. 3 and 4, it can be see how the fixing element 30 fixes the ribbon roller 12 in the ribbon cartridge 10.

The pin 38 of the fixing element 30 is inserted into a hole 123 of the ribbon roller 12. A first tab 121 of the ribbon roller 12 passes through the accommodation means 32 of the fixing element 30 while a second tab 122 passes through the opening 31, so that the two tabs 121 and 122 cannot be rotated. Then, the fastening element 34 engages the ribbon cartridge 10. After the assembly is complete, the support 36 of the fixing element 30 contacts a surface 11 of the ribbon cartridge 10 to locate the position of the ribbon roller 12 in the ribbon cartridge 10 and to prevent the part of the fixing element 30 contacting the ribbon roller 12 from vibrating.

Figure 6:
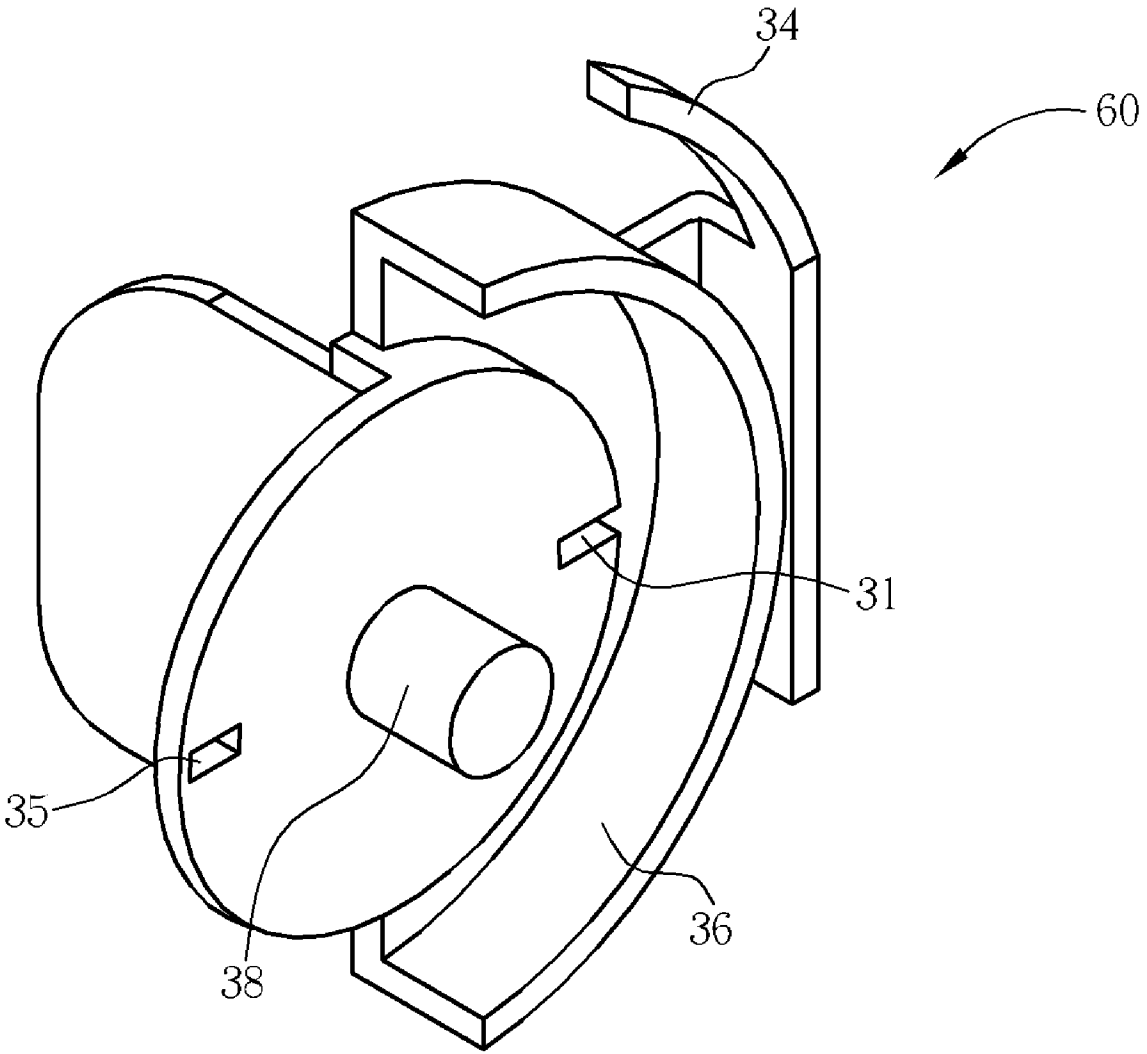
FIG. 6 is another embodiment of the fixing element according to the present invention.

The accommodation means 32 of the fixing element 30 of FIG. 3 is a recess, and the fixing element 30 further comprises protrusions 33 positioned on both sides of the accommodation means 32 for assisting in fixing the first tab 121. Please refer to FIG. 6, which is another embodiment of the fixing element 60 according to the present invention. The accommodation means 35 of the fixing element 60 of FIG. 6 is an opening for accommodating the first tab 121.

If the ribbon cartridge 10 is vibrated by an external force during transportation, a force generated by the fastening element 34 engaging the ribbon cartridge 10 is provided to the fixing element 30 to prevent the ribbon roller 12 from rotating, and the accommodation means 32 and the opening 31 can also assist in preventing the ribbon roller 12 from rotating.

In addition, the fixing element 30 is placed at the ribbon-feeding bay of the ribbon cartridge 10. Since all ribbons of a new ribbon cartridge are rolled in the ribbon-feeding bay, there are only one or two layers of ribbons rolled in the ribbon-driving bay. If the new ribbon cartridge is transported and the ribbon-driving roller of such rotates a little because of external vibration or collision, the rolling force is not large enough to make the ribbon-feeding roller rotate. Thus, the fixing element 30 of the present invention placed in the ribbon-feeding bay can ensure that the ribbon will not dangle out of the ribbon cartridge.

Compared to the prior art, the present invention provides a method and a fixing element to fix the ribbon rollers in the ribbon cartridge. The present invention uses the fastening element to engage the ribbon cartridge, and the accommodation means and the opening to accommodate the tabs to prevent the ribbon roller from rotating. Moreover, the support can locate the position of the ribbon roller in the ribbon cartridge. Therefore, the fixing element of the present invention can prevent the ribbon roller from rotating when transporting the ribbon cartridge.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fixing element for rotatably fixing a ribbon roller in a ribbon cartridge, the fixing element comprising:

an accommodation means for fixing a first tab located on an end of the ribbon roller; and a fastening element for engaging an outer circumference of the ribbon cartridge.

2. The fixing element of claim 1 further comprising an opening for accommodating a second tab located on the end of the ribbon roller.

3. The fixing element of claim 1 further comprising a support contacting a surface of the ribbon cartridge for preventing the fixing element from vibrating.

4. The fixing element of claim 1 further comprising a pin for insertion into a hole located in the end of the ribbon roller.

5. The fixing element of claim 1, wherein the accommodation means is a recess.

6. The fixing element of claim 1, wherein the accommodation means is an opening.

7. The fixing element of claim 1 further comprising protrusions positioned on both sides of the accommodation means.

* * * * *